US011760535B2

(12) United States Patent
Dai

(10) Patent No.: US 11,760,535 B2
(45) Date of Patent: Sep. 19, 2023

(54) STORAGE CONTAINER WITH DRAWER

(71) Applicant: Yi Dai, Guangdong (CN)

(72) Inventor: Yi Dai, Guangdong (CN)

(73) Assignee: Shenzhen Yihong Technology Co., Ltd, Shenzhen (CN)

( * ) Notice: Subject to any disclaimer, the term of this patent is extended or adjusted under 35 U.S.C. 154(b) by 0 days.

(21) Appl. No.: 18/150,807

(22) Filed: Jan. 6, 2023

(65) Prior Publication Data

US 2023/0142977 A1 May 11, 2023

(51) Int. Cl.

| | |
|---|---|
| ***B65D 6/26*** | (2006.01) |
| ***B65D 6/06*** | (2006.01) |
| ***B65D 25/28*** | (2006.01) |
| ***B65D 6/34*** | (2006.01) |

(52) U.S. Cl.

CPC ..... *B65D 11/12* (2013.01); *B65D 11/26* (2013.01); *B65D 25/282* (2013.01)

(58) Field of Classification Search

CPC .... B65D 11/12; B65D 25/282; B65D 21/086; B65D 11/26; B65D 11/1866; B65D 2543/00231

USPC ..... 220/4.28

See application file for complete search history.

(56) References Cited

U.S. PATENT DOCUMENTS

| | | | | |
|---|---|---|---|---|
| 5,007,550 | A * | 4/1991 | Avot | B65D 21/086 220/4.03 |
| 5,251,749 | A * | 10/1993 | Knight | A47B 47/04 |
| 5,603,559 | A | 2/1997 | Yemini | |
| 5,645,329 | A * | 7/1997 | Madock | A47B 81/068 312/9.11 |
| 5,765,707 | A * | 6/1998 | Kenevan | B65D 11/1873 220/4.31 |
| 5,816,674 | A * | 10/1998 | Manos | A47B 87/0284 D9/425 |
| 10,314,399 | B2 | 6/2019 | Wolle et al. | |
| 2003/0038569 | A1 * | 2/2003 | Caldwell, Jr. | A47B 63/06 312/285 |

* cited by examiner

*Primary Examiner* — Stephen J Castellano

(57) ABSTRACT

A storage container includes a slide frame and a drawer movably disposed in the slide frame. The slide frame includes a bottom plate, at least one column and a top plate. The column is disposed between the bottom plate and the top plate. The opposite sides of the bottom plate and the top plate are provided with insertion grooves. One side of the inner wall of each insertion groove is provided with a clamping groove. Clamping plates are disposed at the top end and bottom end of the column. The ends of clamping plates far away from the column extend into the insertion grooves. The clamping plates are provided with clamping blocks connected to the clamping grooves.

7 Claims, 7 Drawing Sheets

STORAGE CONTAINER WITH DRAWER

FIELD OF THE INVENTION

The invention relates to daily necessities and more particularly to a storage container having a drawer.

BACKGROUND OF THE INVENTION

As the name implies, a storage container is a container for storing things. Storage containers are common in daily life. However, the conventional storage containers have the following disadvantages when used:

Conventional storage containers are mostly divided into flip type and drawer type. Flap type storage containers cannot be stacked, which is not conducive to space utilization. The storage containers shall be used with a large slide frame. Moreover, the slide frame generally contains multiple storage containers, which causes large space occupation and cannot be flexibly used to meet the user's needs.

Thus, the need for improvement still exists.

SUMMARY OF THE INVENTION

The invention provides the following technical solution for the purpose above: a storage container, which comprises a slide frame and a drawer movably disposed inside the slide frame, wherein the slide frame comprises a bottom plate, at least one column and a top plate. The column is disposed between the bottom plate and the top plate, the opposite sides of the bottom plate and the top plate are provided with insertion grooves, and one side of the inner wall of each insertion groove is provided with a clamping groove. Clamping plates are disposed at the top end and bottom end of the column, the ends of clamping plates far away from the column extend into the insertion grooves, and the clamping plates are also provided with clamping blocks connected to the clamping grooves; a positioning enclosure is disposed on the bottom of the bottom plate, and a positioning groove matching the positioning enclosure for stacking two slide frames is disposed on the top of the top plate; a slide rail is disposed on the top of the bottom plate, a slide rod matching the slide rail is disposed on the bottom of the drawer, and the slide rod is movably disposed in the slide rail, so that the slide rod can only slide along the track of the slide rail.

As a preferred technical solution of the invention, a reinforcing enclosure is disposed on the top of the drawer, a handle is disposed on one side of the reinforcing enclosure, and the drawer, the reinforcing enclosure and the handle are integrally formed.

As a preferred technical solution of the invention at least one hollow groove is disposed at the bottom of the bottom plate, and at least one abrasive strip II is disposed at the bottom of the drawer to increase the friction between the bottom of the drawer and the top of the bottom plate.

As a preferred technical solution of the invention both the top end and the bottom end of the column are provided with inserting plates on both sides of the clamping plates. The ends of the inserting plates far from the column extend into the insertion grooves, and the sides of the clamping plates far from the clamping blocks are provided with reinforcing ribs.

As a preferred technical solution of the invention, at least one support rib is disposed on the side of the column towards the drawer, and the inserting plates, the clamping plates, the reinforcing ribs and the clamping blocks are integrally formed.

As a preferred technical solution of the invention, a connecting enclosure is disposed on the top of the bottom plate, the insertion grooves on the bottom plate are disposed in the connecting enclosure, side plates are disposed at both bottom sides of the top plate, and the insertion grooves on the top plate are disposed in the side plates.

As a preferred technical solution of the invention, the positioning enclosure is also provided with at least one positioning annular groove for placing rubber pads. The slide rail comprises a guide rail I and a guide rail II fixedly disposed on the bottom plate and respectively located on both sides of the slide rod. One end of the guide rail II is fixedly connected to one side of the inner wall of the connecting enclosure through a connecting part.

As a preferred technical solution of the invention, the clamping grooves are inclined. Clamping parts are disposed at the bottoms of the clamping grooves. The clamping blocks are clamped with the clamping parts.

As a preferred technical solution of the invention through holes corresponding to the clamping parts are disposed at the bottom of the bottom plate and the top of the top plate. The clamping blocks can be warped by tools through the through holes.

As a preferred technical solution of the invention, at least one abrasive strip I is disposed in the positioning groove. When stacking two slide frames, the abrasive strip I increases the friction between the positioning groove and the positioning enclosure.

The invention has the following advantages and benefits in comparison with the conventional art:

The storage container of the invention is equipped with a slide frame and a drawer, and adopts the drawer type to achieve independent use, or multiple products can be stacked together for use without affecting the independent drawing action. The bottom plate, column and top plate, which form the slide frame, are movably clamped. Therefore, the invention has the advantages of convenient disassembly and assembly, high stability after assembly, low cost and practicality, and broad application prospects.

The above and other objects, features and advantages of the invention will become apparent from the following detailed description taken with the accompanying drawings

DETAILED DESCRIPTION OF THE INVENTION

The technical solutions in the embodiments of the invention are clearly and completely described in combination with the drawings in the embodiments of the invention. Obviously, the described embodiments are only a part but not all of the invention. Based on the embodiments of the invention, all other embodiments obtained by any ordinary technician in the art without any creative work shall fall within the protection scope of the invention.

Figure 1:
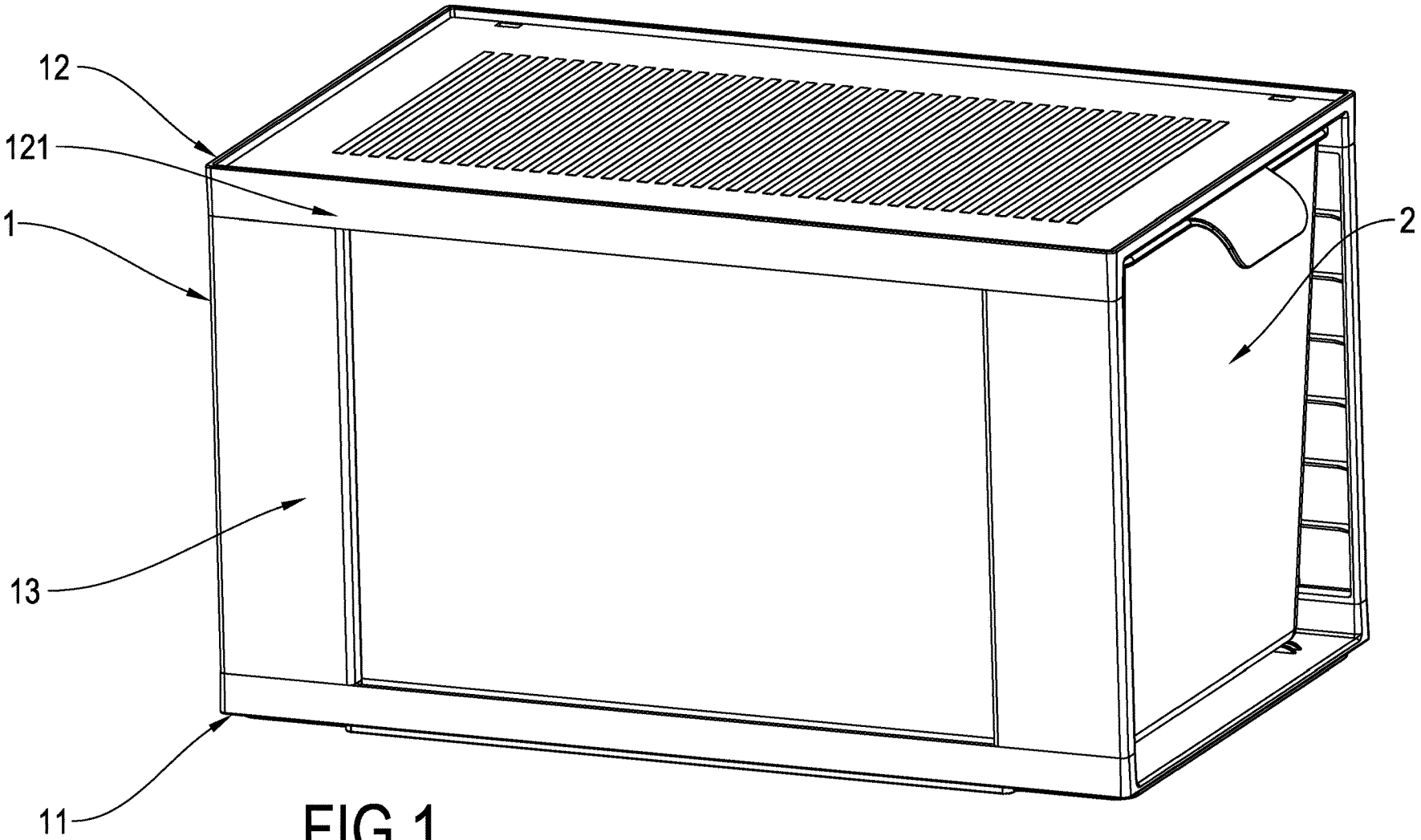
FIG. 1 is a perspective view of a storage container of the invention.
Figure 2:
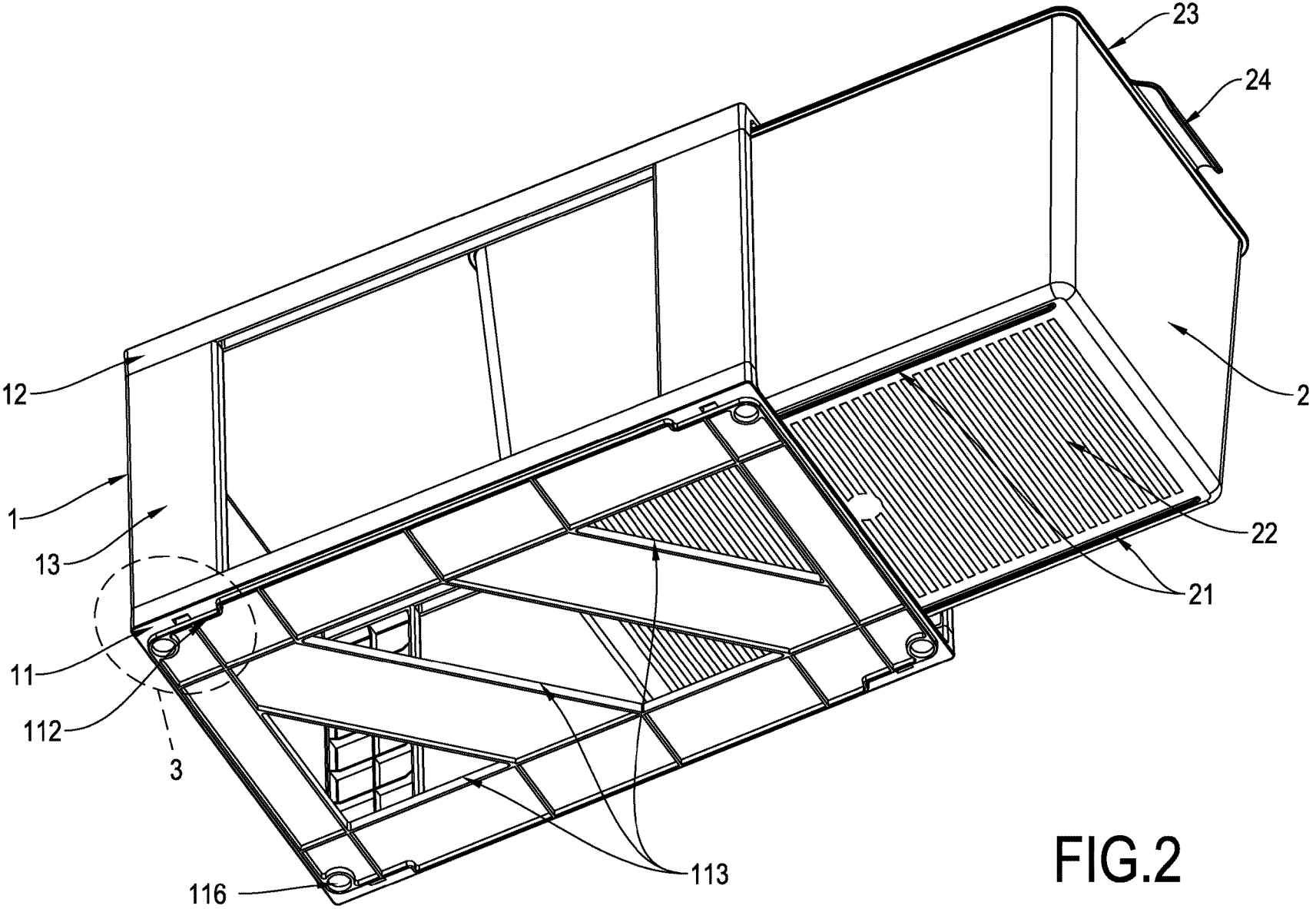
FIG. 2 is a perspective view of the storage container with the drawer being drawn out.
Figure 3:
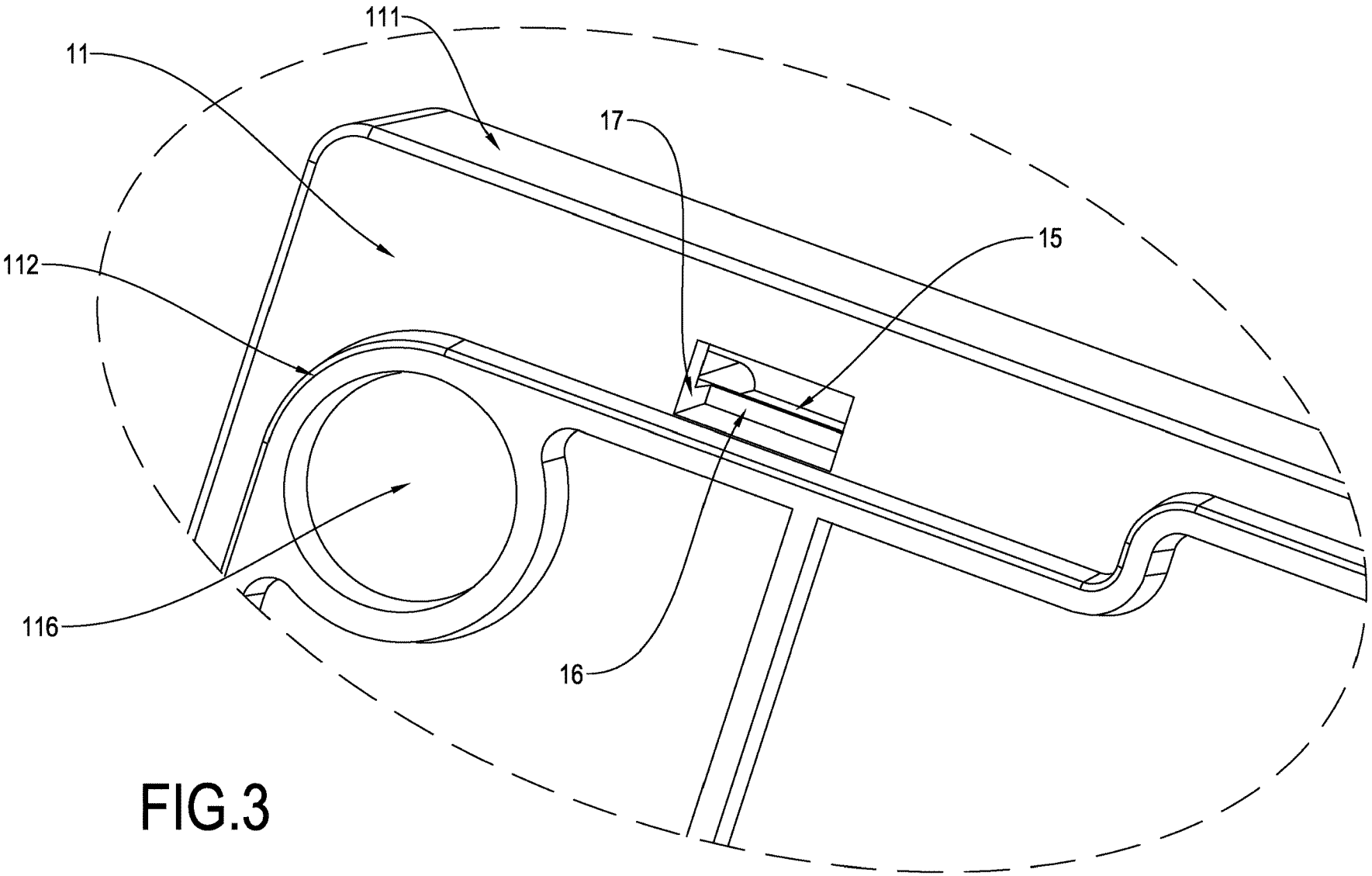
FIG. 3 is a detailed view of the area in ellipse 3 of FIG. 2.
Figure 4:
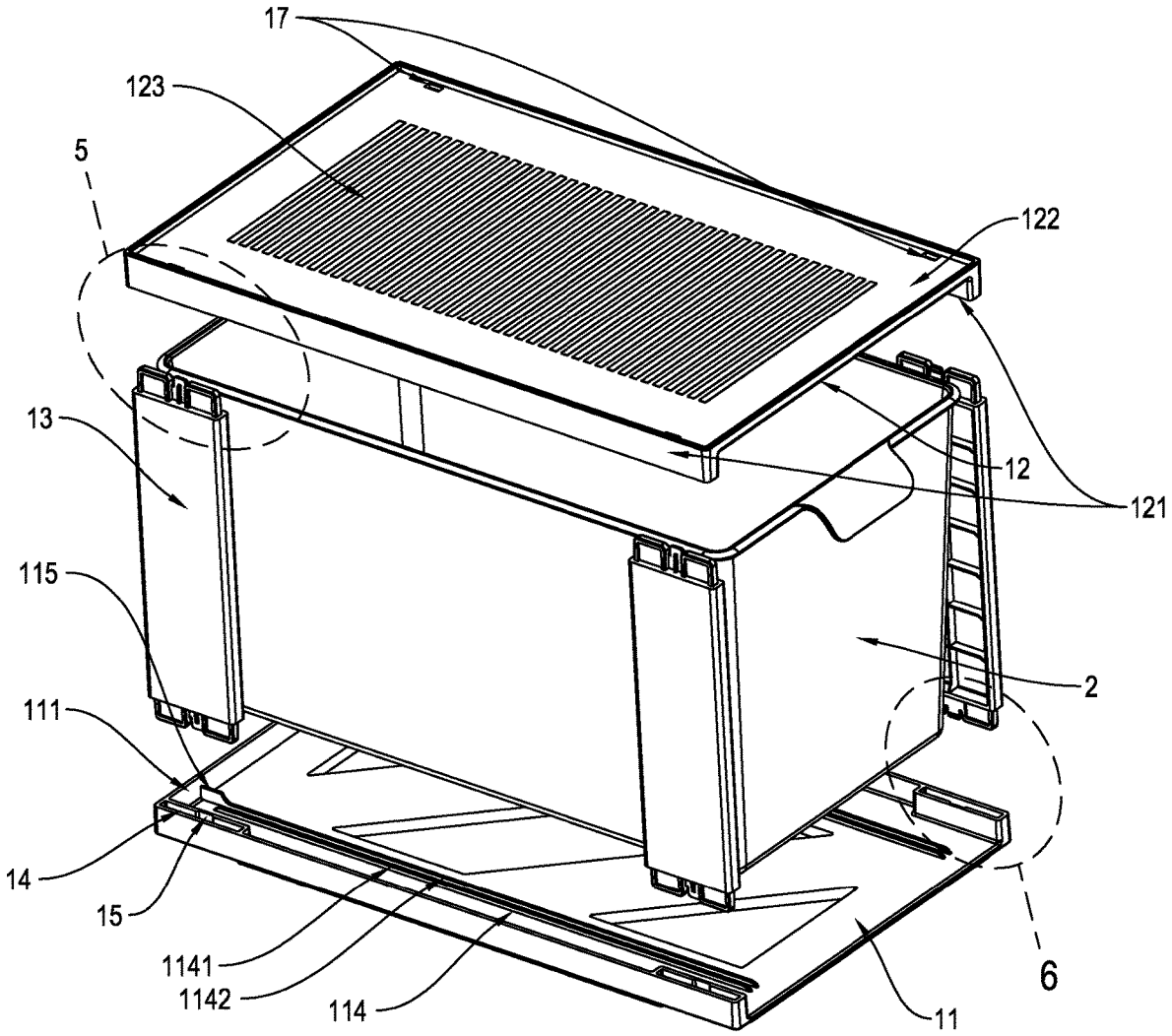
FIG. 4 is an exploded view of the storage container.
Figure 5:
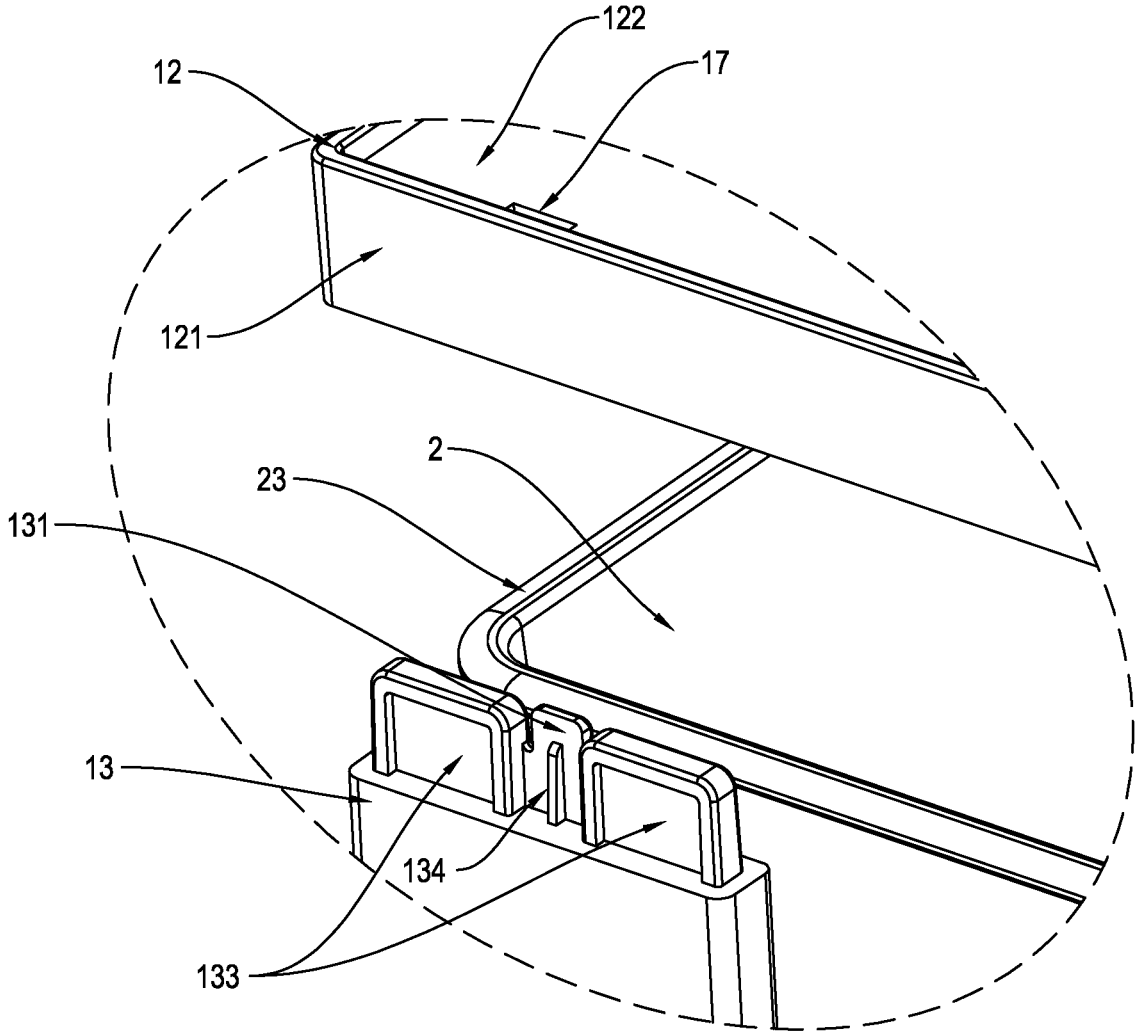
FIG. 5 is a detailed view of the area in ellipse 5 of FIG. 4.
Figure 6:
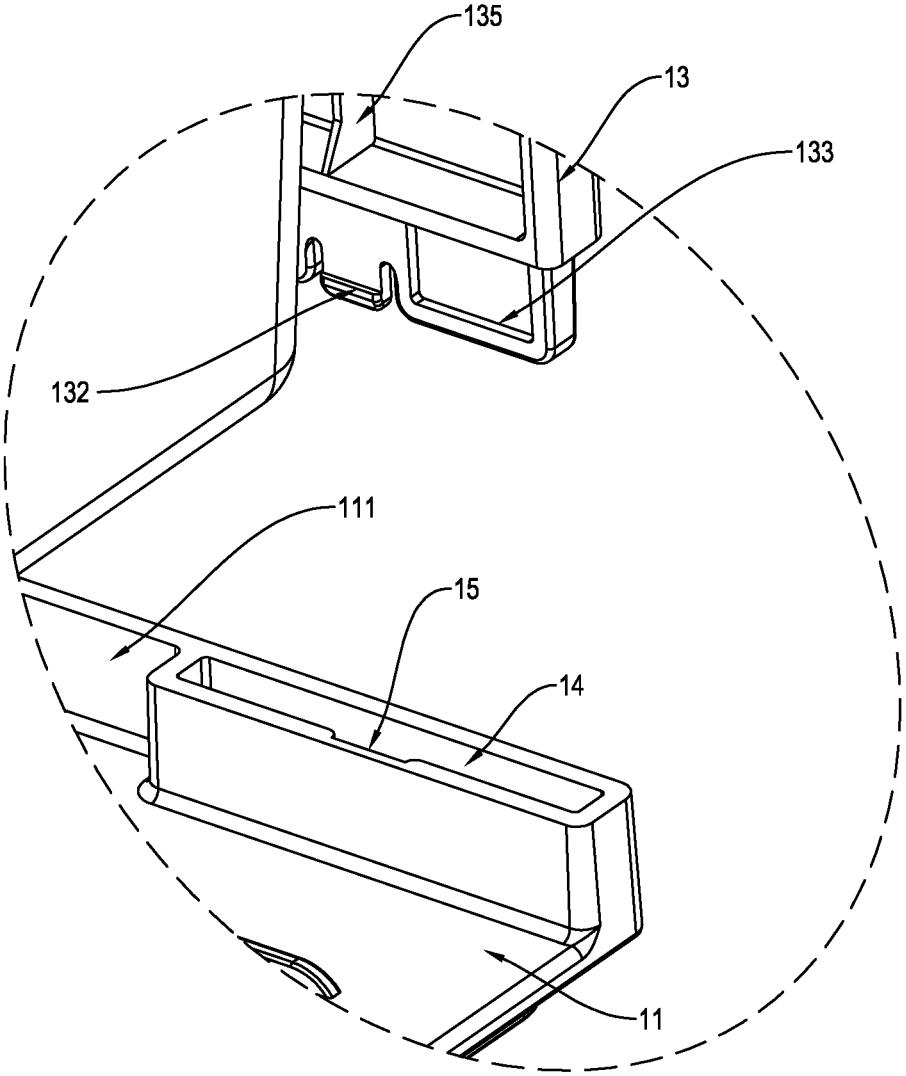
FIG. 6 is a detailed view of the area in ellipse 6 of FIG. 4.
Figure 7:
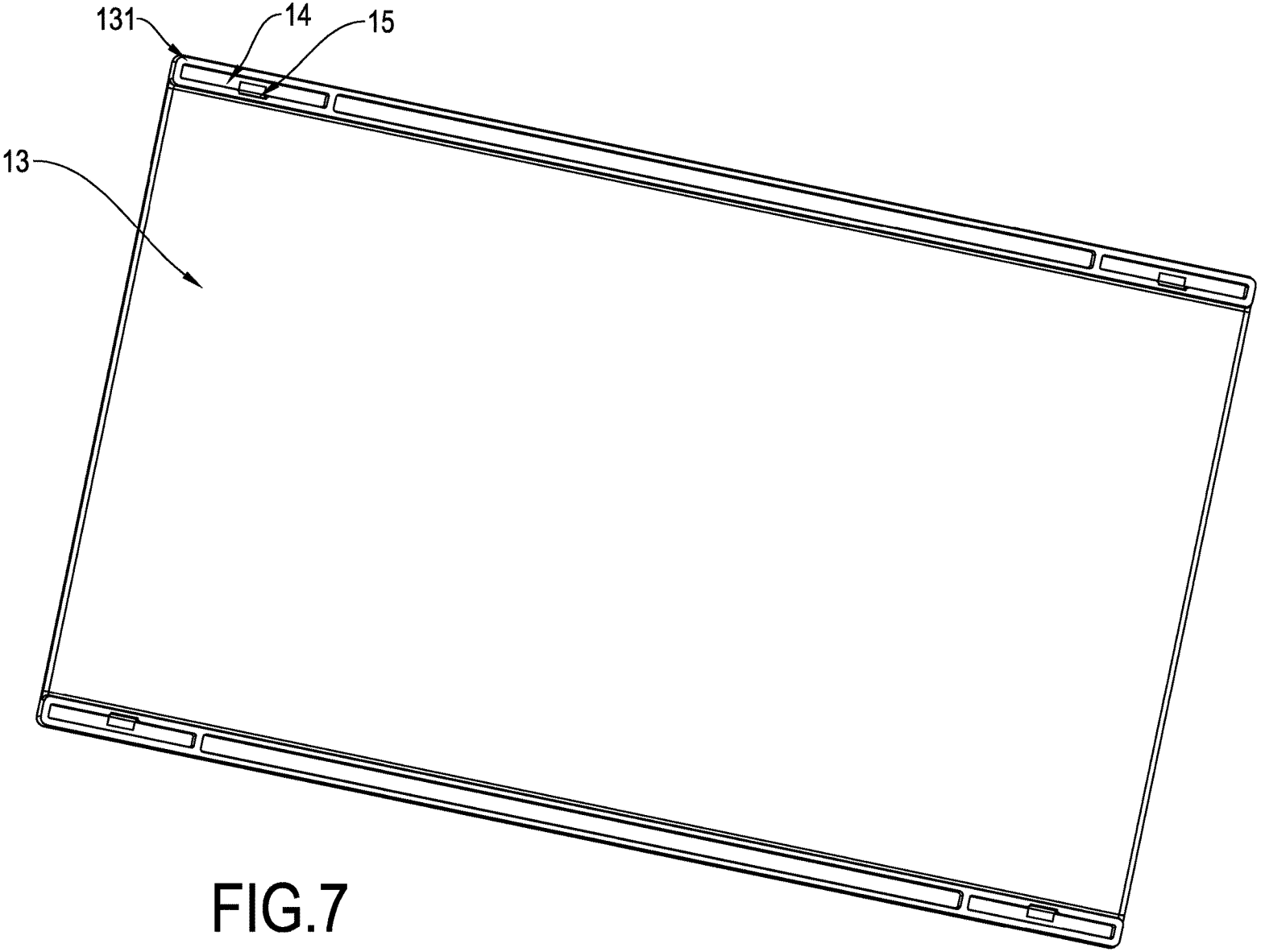
FIG. 7 is a plan view of the top plate.

Referring to FIGS. 1 to 7, a storage container of the invention comprises a slide frame 1 and a drawer 2 movably disposed in the slide frame 1. The slide frame 1 comprises a bottom plate 11, at least one column 13 and a top plate 12. The column 13 is disposed between the bottom plate 11 and the top plate 12, the opposite sides of the bottom plate 11 and the top plate 12 are provided with insertion grooves 14, and one side of the inner wall of each insertion groove 14 is provided with a clamping groove 15. Clamping plates 131 are disposed at the top end and bottom end of the column 13, the ends of clamping plates 131 far away from the column 13 extend into the insertion grooves 14, and the clamping plates 131 are also provided with clamping blocks 132 connected to the clamping grooves 15.

A positioning enclosure 112 is disposed on the bottom of the bottom plate 11, and a positioning groove 122 matching the positioning enclosure 112 for stacking two slide frames 1 is disposed on the top of the top plate 12.

A slide rail 114 is disposed on the top of the bottom plate 11, a slide rod 21 matching the slide rail 114 is disposed on the bottom of the drawer 2, and the slide rod 21 is movably disposed in the slide rail 114, so that the slide rod 21 can only slide along the track of the slide rail 114.

As a specific technical solution of the embodiment, a reinforcing enclosure 23 is disposed on the top of the drawer 2, a handle 24 is disposed on one side of the reinforcing enclosure 23, and the drawer 2, the reinforcing enclosure 23 and the handle 24 are integrally formed. The reinforcing enclosure 23 effectively improves the structural strength of the opening of the drawer 2, avoiding cracks and damages. The handle 24 disposed in an arc shape is beautiful and comfortable to hold. The drawer 2, the reinforcing enclosure 23 and the handle 24 are integrally formed, further ensuring the structural strength.

As a specific technical solution of the embodiment, at least one hollow groove 113 is disposed at the bottom of the bottom plate 11, and at least one abrasive strip II 22 is disposed at the bottom of the drawer 2 to increase the friction between the bottom of the drawer 2 and the top of the bottom plate 11. The hollow groove 113 saves the raw materials for processing the bottom plate 11, and is conducive to releasing the stress generated during the forming of the bottom plate 11, reducing the weight of the bottom plate 11, and then making the product lighter as a whole. The friction resistance between the abrasive strip II 22 and the hollow groove 113 is high, so the user needs to pull the drawer 2 with a little force, which ensures the stability of the drawer 2.

As a specific technical solution of the embodiment, both the top end and the bottom end of the column 13 are provided with inserting plates 133 on both sides of the clamping plates 131. The ends of the inserting plates 133 far from the column 13 extend into the insertion grooves 14, and the sides of the clamping plates 131 far from the clamping blocks 132 are provided with reinforcing ribs 134. The reinforcing ribs 134 ensure the stability of the clamping plates 131 and avoids the fracture after multiple plugging and pulling. The inserting plates 133 increase the stability and area of the connection between the column 13 and the bottom plate 11 and the top, and can also protect the clamping plates 131. When the product is disassembled, since the inserting plates 133 are located on both sides of the clamping plates 131, the clamping plates 131 will not be damaged in case of collision.

As a specific technical solution of the embodiment, at least one support rib 135 is disposed on the side of the column 13 towards the drawer 2, and the inserting plates 133, the clamping plates 131, the reinforcing ribs 134 and the clamping blocks 132 are integrally formed. A plurality of support ribs 135 are disposed on the side of the column 13 towards the drawer 2, which ensures the overall structural strength of the column 13, while saving processing raw materials, which is economical.

As a specific technical solution of the embodiment, a connecting enclosure 111 is disposed on the top of the bottom plate 11, the insertion grooves 14 on the bottom plate 11 are disposed in the connecting enclosure 111, side plates 121 are disposed at both bottom sides of the top plate 12, and the insertion grooves 14 on the top plate 12 are disposed in the side plates 121. The connecting enclosure 111 is used to cover one side of the drawer 2. One side of the connecting enclosure 111 has a gap, so that the drawer 2 can be drawn freely through the gap. The side plates 121 can cover both sides of the drawer 2. Since the enclosure limits the drawing direction of the drawer 2, the top plate 12 only needs to protect both sides of the drawer 2 on the side plates 121. The insertion grooves 14 are in the side plates 121 and the connecting enclosure 111. The hidden design makes the appearance beautiful.

As a specific technical solution of the embodiment, the positioning enclosure 112 is also provided with at least one positioning annular groove 116 for placing rubber pads. The slide rail 114 comprises a guide rail 11141 and a guide rail II 1142 fixedly disposed on the bottom plate 11 and respectively located on both sides of the slide rod 21. One end of the guide rail II 1142 is fixedly connected to one side of the inner wall of the connecting enclosure 111 through a connecting part 115. The positioning annular groove 116 is used for installing the rubber pads. After the rubber pads are installed in the positioning annular groove 116, the positioning enclosure 112 does not directly contact the ground. The contact between the rubber pads and the ground makes the anti-skid effect better, and also reduces the wear of the positioning enclosure 112. The guide rail I 1141 and guide rail II 1142 are used together with the slide rod 21 to ensure the stability of the drawer 2 during storage. At the same time, one end of the guide rail II 1142 is fixedly connected to the connecting enclosure 111 through the connecting part 115. When the connecting enclosure 111 is impacted by the drawer 2, the connecting enclosure 111 pulls the guide rail II 1142 through the connecting part 115, which further ensures the stability of the connecting enclosure 111 and the guide rail II 1142.

As a specific technical solution of the embodiment, the clamping grooves 15 are inclined. Clamping parts 16 are disposed at the bottoms of the clamping grooves 15. The clamping blocks 132 are clamped with the clamping parts 16. The clamping blocks 132 respectively with arc-shaped end match with the inclined clamping grooves 15, which facilitates the insertion of the clamping blocks 132 and makes the insertion process smoother. The clamping parts 16 can be stably clamped with the clamping blocks 132, making the connection between the column 13, the bottom plate 11 and the top more stable.

As a specific technical solution of the embodiment, through holes 17 corresponding to the clamping parts 16 are disposed at the bottom of the bottom plate 11 and the top of the top plate 12. The clamping blocks 132 can be warped by tools through the through holes 17. When disassembling the bottom plate 11, the column 13 and the top plate 12, a screwdriver or any other tool can be used to lift the clamping blocks 132 through the through holes 17 at the bottom of the bottom plate 11 and the top plate 12, so that the clamping blocks 132 are separated from the clamping parts 16, and then the clamping plates 131 can be pulled out from the clamping grooves 15. The operation is simple and fast.

As a specific technical solution of the embodiment, at least one abrasive strip 1123 is disposed in the positioning groove 122. When stacking two slide frames 1, the abrasive strip I 123 increases the friction between the positioning groove 122 and the positioning enclosure 112. When stacking two slide frames 1, the bottom of the positioning enclosure 112 contacts with the abrasive strip 1123 to make the connection more stable When in use, pull the drawer 2 through the handle 24, the drawer 2 drives the slide table to slide in the slide rail 114, and the drawer 2 is taken out through the gap at one side of the connecting enclosure 111. When multiple products are stacked together, lift the other slide frame 1, and clamp the positioning enclosure 112 at the bottom of the slide frame 1 with the positioning groove 122 at the top of the other slide frame 1, so that the two slide frames 1 can be combined. When disassembling the slide frame 1, use a tool to tilt the clamping blocks 132 through the through holes 17 at the bottom of the bottom plate 11 and the top plate 12, so that the clamping blocks 132 are separated from the clamping parts 16. In this way, the clamping plates 131 are pulled out from the clamping grooves 15. After that, the bottom plate 11, the column 13 and the top plate 12 can be disassembled. The above is the operation method of the product.

The invention has the following advantages and benefits in comparison with the conventional storage containers: the storage container is equipped with the slide frame 1 and the drawer 2, and adopts the drawer type to achieve independent use, or multiple products can be stacked together for use without affecting the independent drawing action. The bottom plate 11, column 13 and top plate 12, which form the slide frame 1, are movably clamped. Therefore, the invention has the advantages of convenient disassembly and assembly, high stability after assembly, low cost and practicality, and broad application prospects While the invention has been described in terms of preferred embodiments, those skilled in the art will recognize that the invention can be practiced with modifications within the spirit and scope of the appended claims.

What is claimed is:

1. A storage container, comprising:

a slide frame;

a drawer movably disposed inside the slide frame wherein the slide frame comprises a bottom plate, at least one column, and a top plate; the column is disposed between the bottom plate and the top plate; the opposite sides of the bottom plate and the top plate are provided with a plurality of insertion grooves; and one side of an inner wall of each insertion groove is provided with a clamping groove;

a plurality of clamping plates disposed at top and bottom ends of the column respectively wherein ends of clamping plates distal the column extend into the insertion grooves, and the clamping plates are provided with a plurality of clamping blocks connected to the clamping grooves;

a positioning enclosure disposed on a bottom of the bottom plate;

a positioning groove matching the positioning enclosure for stacking two slide frames disposed on a top of the top plate;

a slide rail disposed on a top of the bottom plate; and a slide rod matching the slide rail disposed on a bottom of the drawer;

wherein the slide rod is movably disposed in the slide rail so that the slide rod is configured to only slide along the slide rail.

2. The storage container of claim 1, further comprising a reinforcing enclosure disposed on a top of the drawer, and a handle disposed on one side of the reinforcing enclosure wherein the drawer, the reinforcing enclosure and the handle are integrally formed.

3. The storage container of claim 1, further comprising at least one hollow groove disposed at the bottom of the bottom plate, and at least one abrasive strip is disposed at the bottom of the drawer to increase friction between the bottom of the drawer and the top of the bottom plate.

4. The storage container of claim 1, wherein both the top and bottom ends of the column are provided with a plurality of inserting plates on both sides of the clamping plates respectively; the ends of the inserting plates distal the column extend into the insertion grooves; and the sides of the clamping plates distal the clamping blocks are provided with a plurality of reinforcing ribs.

5. The storage container of claim 4, further comprising at least one support rib disposed on the side of the column towards the drawer wherein the inserting plates, the clamping plates, the reinforcing ribs and the clamping blocks are integrally formed.

6. The storage container of claim 1, further comprising a connecting enclosure disposed on the top of the bottom plate and a plurality of side plates disposed at both bottom sides of the top plate wherein the insertion grooves on the bottom plate are disposed in the connecting enclosure, and the insertion grooves on the top plate are disposed in the side plates.

7. The storage container of claim 1, further comprising at least one abrasive strip disposed in the positioning groove wherein when stacking two slide frames, the abrasive strip increases friction between the positioning groove and the positioning enclosure.

* * * * *